US007128350B2

(12) United States Patent
Eckerdt

(10) Patent No.: US 7,128,350 B2
(45) Date of Patent: Oct. 31, 2006

(54) SLIDING SLAM LATCH STRIKE

(75) Inventor: George H. Eckerdt, Victor, NY (US)

(73) Assignee: Key Systems, Inc., Fishers, NY (US)

( * ) Notice: Subject to any disclaimer, the term of this patent is extended or adjusted under 35 U.S.C. 154(b) by 0 days.

(21) Appl. No.: 10/640,911

(22) Filed: Aug. 14, 2003

(65) Prior Publication Data

US 2004/0189021 A1 Sep. 30, 2004

Related U.S. Application Data

(60) Provisional application No. 60/458,020, filed on Mar. 28, 2003.

(51) Int. Cl.
*E05B 15/02* (2006.01)

(52) U.S. Cl. ..... 292/341.16; 70/277

(58) Field of Classification Search ..... 292/341.15, 292/341.16, 144; 70/277
See application file for complete search history.

(56) References Cited

U.S. PATENT DOCUMENTS 3,638,461 A * 2/1972 Watson ..... 70/92
3,765,709 A * 10/1973 Van Wyck ..... 292/33
4,691,948 A * 9/1987 Austin et al. ..... 292/171
5,850,753 A * 12/1998 Varma ..... 70/278.7
5,915,766 A * 6/1999 Baumeister et al. ... 292/341.15
6,116,067 A * 9/2000 Myers et al. ..... 70/279.1

* cited by examiner

*Primary Examiner*—Gary Estremsky
(74) *Attorney, Agent, or Firm*—Brown & Michaels, PC
Eugene Stephens & Associates

(57) ABSTRACT

This disengageable strike has a strike annexed to a strike member that is slideably mounted to a strike base. The strike member and strike base are, in turn, mounted to a door frame or door opposite a slam latch. In a first position, the strike engages the latch to prevent the door from opening. An electrically disengageable inhibitor prevents manual movement of the sliding strike from the first position. However, when the inhibitor is disengaged, the strike can be manually moved/slid using an actuator (in the form of a handle annexed to the strike member) to a second position where it does not engage the latch to prevent the door from opening. A biasing spring biasing the strike and strike member towards the first position helps to return it to the first position after the actuator is released. Further, one portion of a sensor for a signal generator is mounted to the strike member such that it is opposite the other portion in the door or frame only when the strike is in the first position. Thus, the signal generator will indicate the door is close only when the door is closed and the strike has been returned to the first position.

47 Claims, 10 Drawing Sheets

SLIDING SLAM LATCH STRIKE

RELATED APPLICATIONS

Figure 1A:
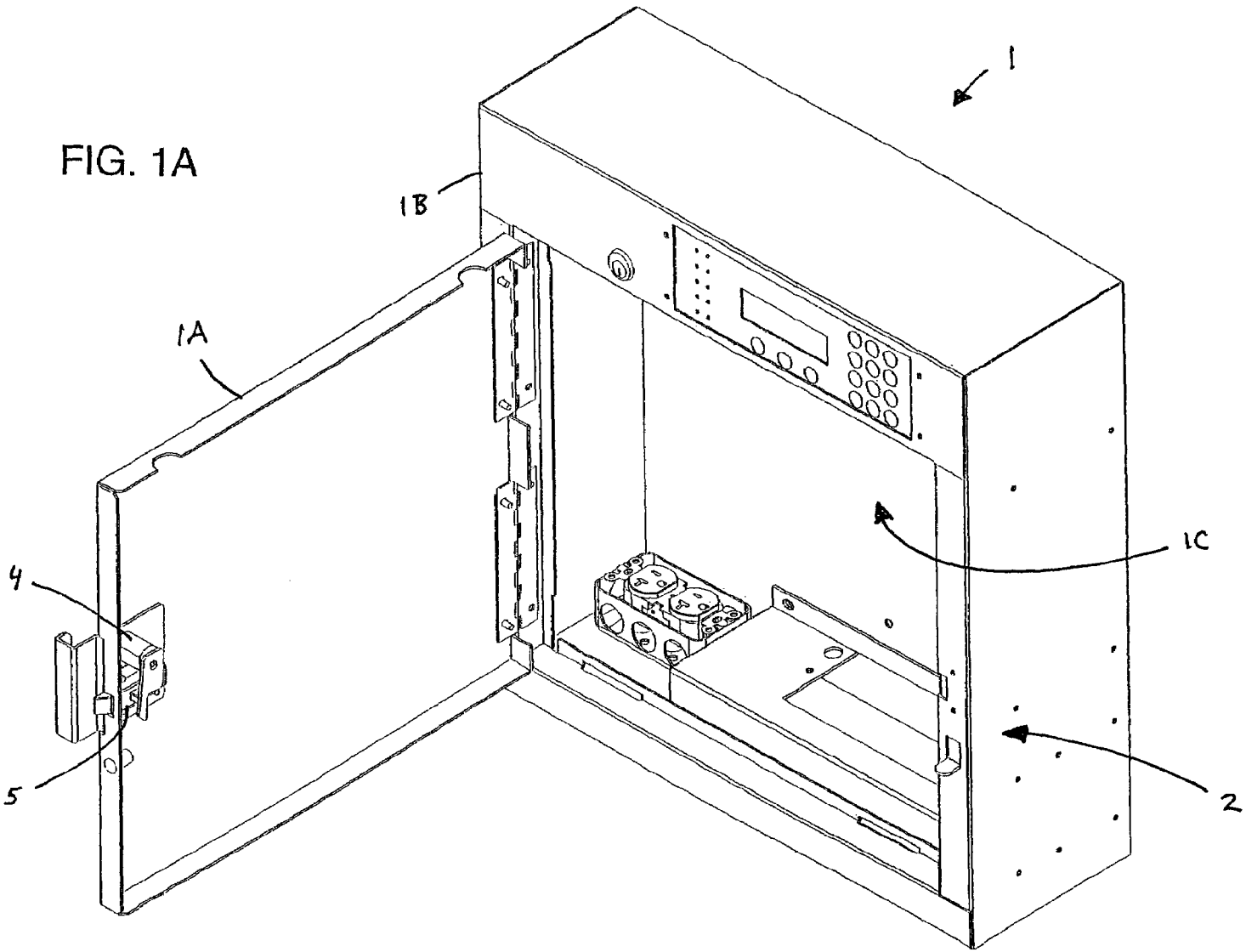

This application claims the benefit of U.S. Provisional Application No. 60/458,020, filed on 28 Mar. 2003, which provisional application is incorporated by reference herein.

FIELD OF THE INVENTION

This invention relates generally to enclosures with closure elements such as doors used to control access to keys and other secured assets, and more particuiarly to the field of electronically controlled secured asset dispensers ("lock boxes") having disengageable strikes.

BACKGROUND OF THE INVENTION

Doors using key or combination locks to control access to other keys and/or other controlled assets or areas have been in existence in one form or another for centuries if not millennia. Currently, it is typical for such doors to include a latch with an extendable tongue mounted to the door such that the tongue catches behind a strike on the frame of the door when extended. Latches of this type usually feature a spring biased tongue member with a ramped edge (on the side facing the door opening) so that the door can be slammed or closed even when the tongue is extended and the latch is locked. Such locks/latches are, therefore, commonly referred to as "slam latches" in the art. More recently, doorjambs have also been fitted with electrically disengageable hinged strikes. These hinged strikes are spring biased to their normal position and are maintained in that position by a strike holding mechanism that can be deactivated by the plunger of a solenoid as long as the solenoid is activated by an electrical current. While this hinged strike holding mechanism is deactivated, the hinged strike is free to rotate outward such that it no longer serves to engage and retain the tongue of a latch mounted to the door. This, in turn, allows the door to be opened even though the tongue of its latch has not been unlocked/withdrawn. Usually electronic means actuated by a keyboard and/or card are used to electrically trigger the solenoid so that it deactivates the hinged strike holding mechanism and thereby allows the hinged strike to rotate outward, releasing the door to be opened.

Dual access systems of the type described above have several advantages. First, selected individuals can be allowed access to a closed structure or lock box without possessing a key as long as they possess the requisite means. Such means can take the form of a keyboard personal identification number (a "PIN"), a card, a fingerprint, an eye print, and/or any other means necessary to deactivate the strike for its latch. Second, the use of a key provides a simple non-electrical means for opening the lock when electricity is absent or temporarily unavailable. Third, such means (e.g. in the form of a "master key") simultaneously provide those in overall authority with easy access to the contents of the lock box or secured structure. Fourth, such systems work very well for security purposes. Electronic systems retain a memory of those accessing contents or the interior of structures via electronic means, while those authorized and possessing keys are limited in number and known.

Despite their advantages, such systems also have a notable disadvantage: the hinged strike holding mechanism can jam. This is particularly a problem if the door or door jamb is warped or when too much material is stuffed into a lock box or secured structure prior to closing its door. This can lead to binding forces on the strike holding mechanism preventing it from unlocking and releasing the door.

The jamming problem associated with hinged strikes is exacerbated by another factor. Most secured doors of the type discussed herein are provided with a sensor/signal generator so that it can easily be determined whether the door is open or closed. Such signal generators typically use a system (such as a "Reed switch") where one part of the sensor is placed in the frame and another placed opposite in the door. When the door is open and the parts are no longer adjacent, this state is indicated. Likewise, when the door is closed and the sensor parts are adjacent, this state is indicated. Since doors fitted with slam latches are normally locked when closed, an indication that the door is closed will normally be taken as a signal that it is secured (and its strike holding mechanism properly engaged), even when this is not the case. Thus, there is a substantial need for a disengageable strike that will avoid the jamming features discussed above. There is also a substantial need for a system that will indicate not only that a door is closed, but that its disengageable strike is engaged and in a position where it will securely engage the slam latch for a secured enclosure.

SUMMARY OF THE INVENTION

I have invented a new form of disengageable strike. This strike is annexed to a strike member slideably mounted to a strike base. The strike member and strike base are, in turn, mounted to the doorframe or door opposite the slam latch. In a first position, my strike engages the latch to prevent the door from opening. Normally, an electrically disengageable inhibitor prevents manual movement of my sliding strike from the first position. However, when the inhibitor is disengaged, the strike can be manually moved/slid using an actuator (in the form of a handle annexed to the strike member) to a second position where it does not engage the latch to prevent the door from opening. A biasing spring biasing the strike and strike member towards the first position helps to return it to the first position after the actuator is released. Further, one portion of the sensor/signal generator in my invention is mounted to the strike member such that it is opposite the other portion in the door or frame only when the strike is in the first position. Thus, the sensor/signal generator will indicate the door is close only when the door is closed and the strike has been returned to the first position.

BRIEF DESCRIPTION OF THE DRAWING FIGURES

FIG. 1A provides a first perspective view of a secured asset dispenser including a sliding latch strike in accordance with the teachings of my invention.

Figure 1B:
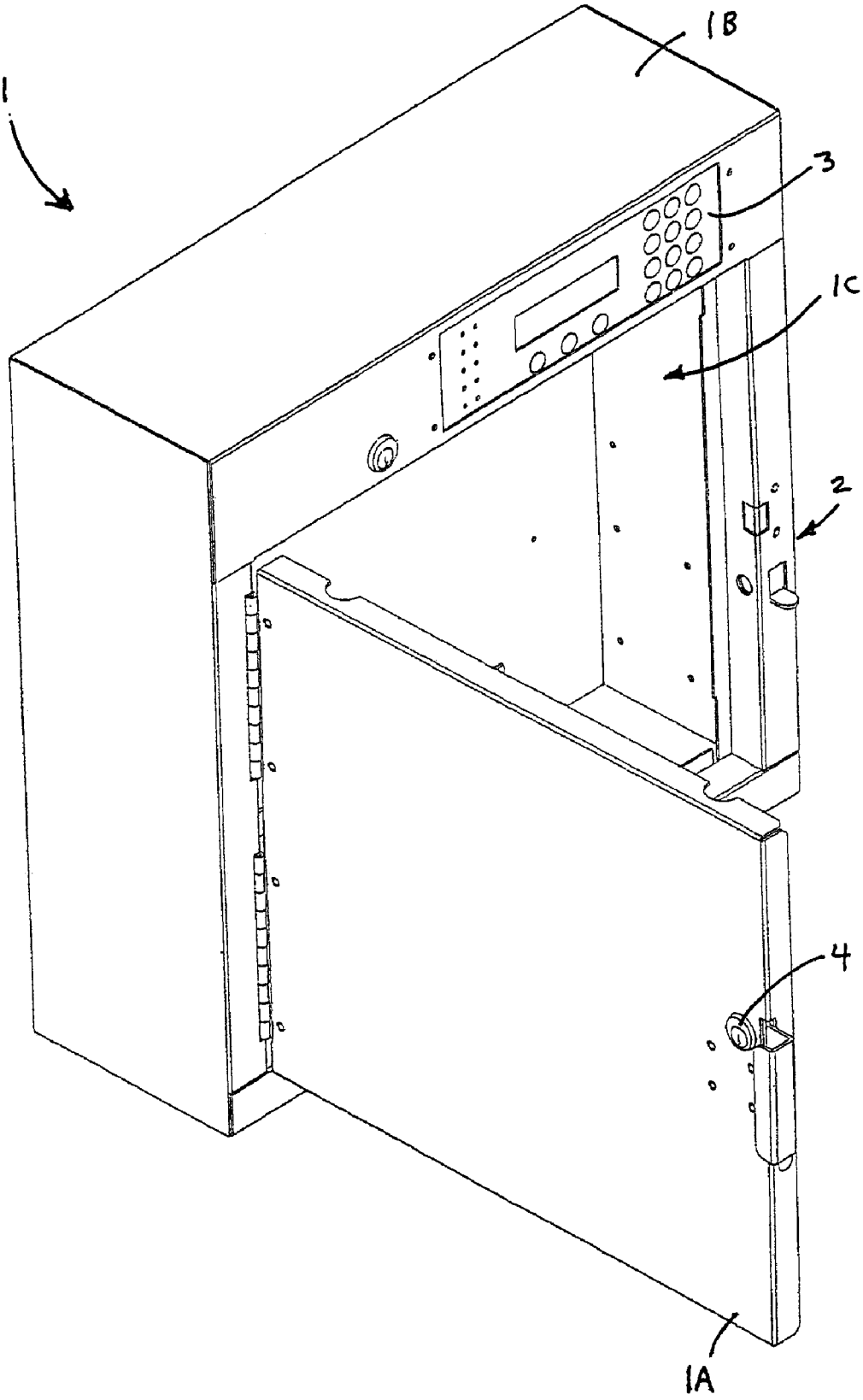

FIG. 1B provides a second perspective view of a secured asset dispenser including a sliding latch strike in accordance with the teachings of my invention.

Figure 2A:
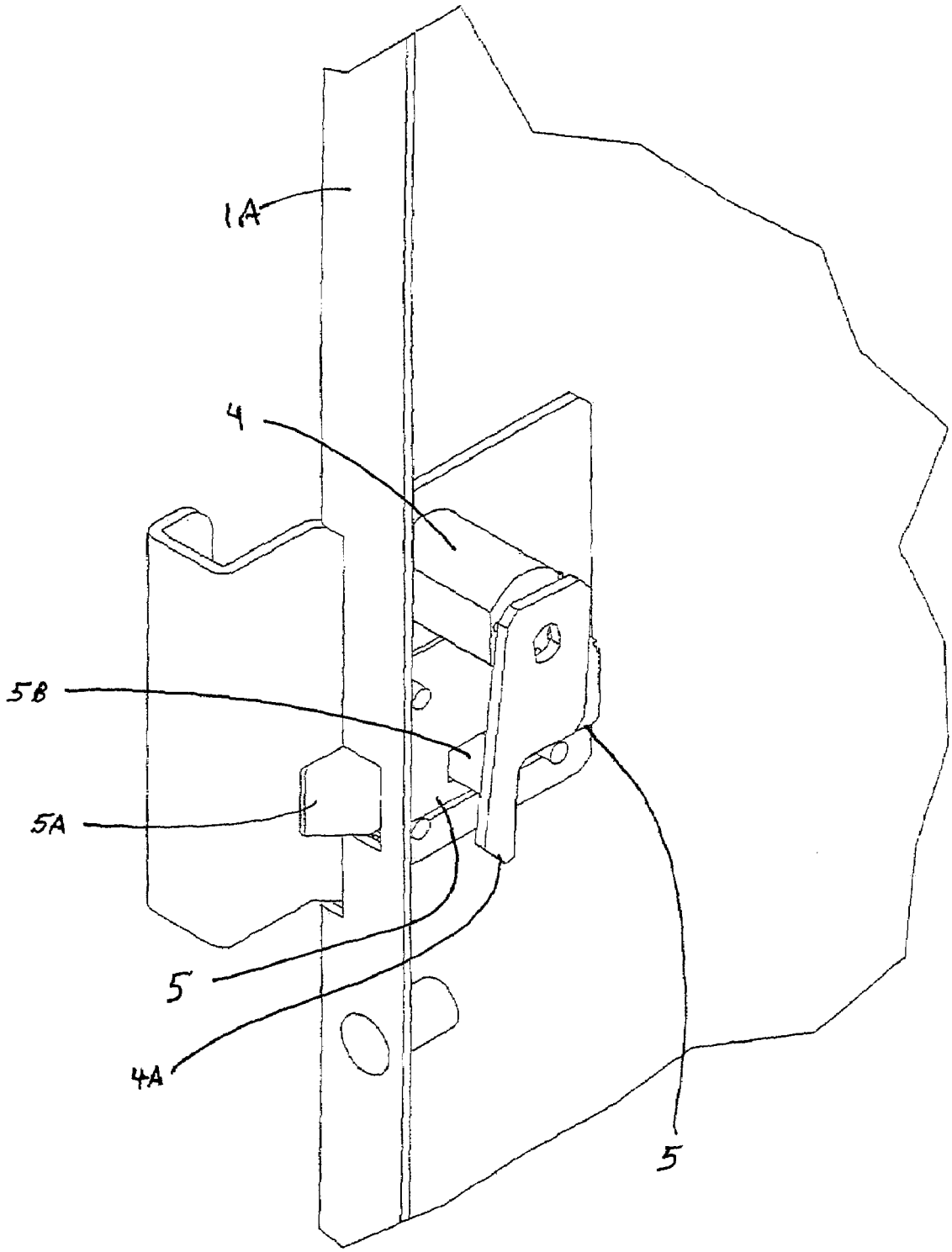

FIG. 2A provides a more detailed perspective view showing a portion of the door illustrated in FIG. 1A where a key actuated slam latch is mounted.

Figure 2B:
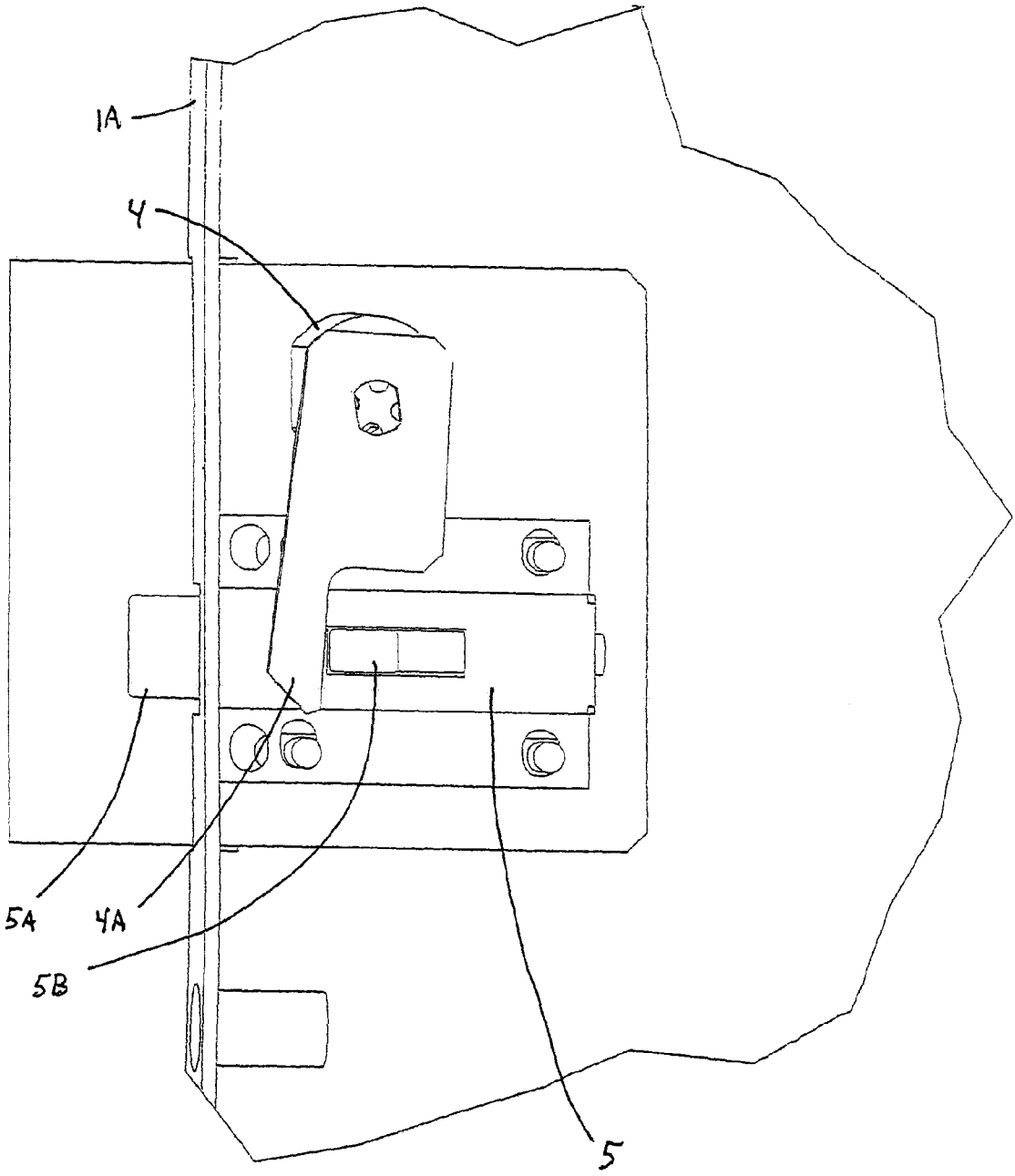

FIG. 2B provides different perspective view of the portion of the door illustrated in FIG. 2A.

Figure 3A:
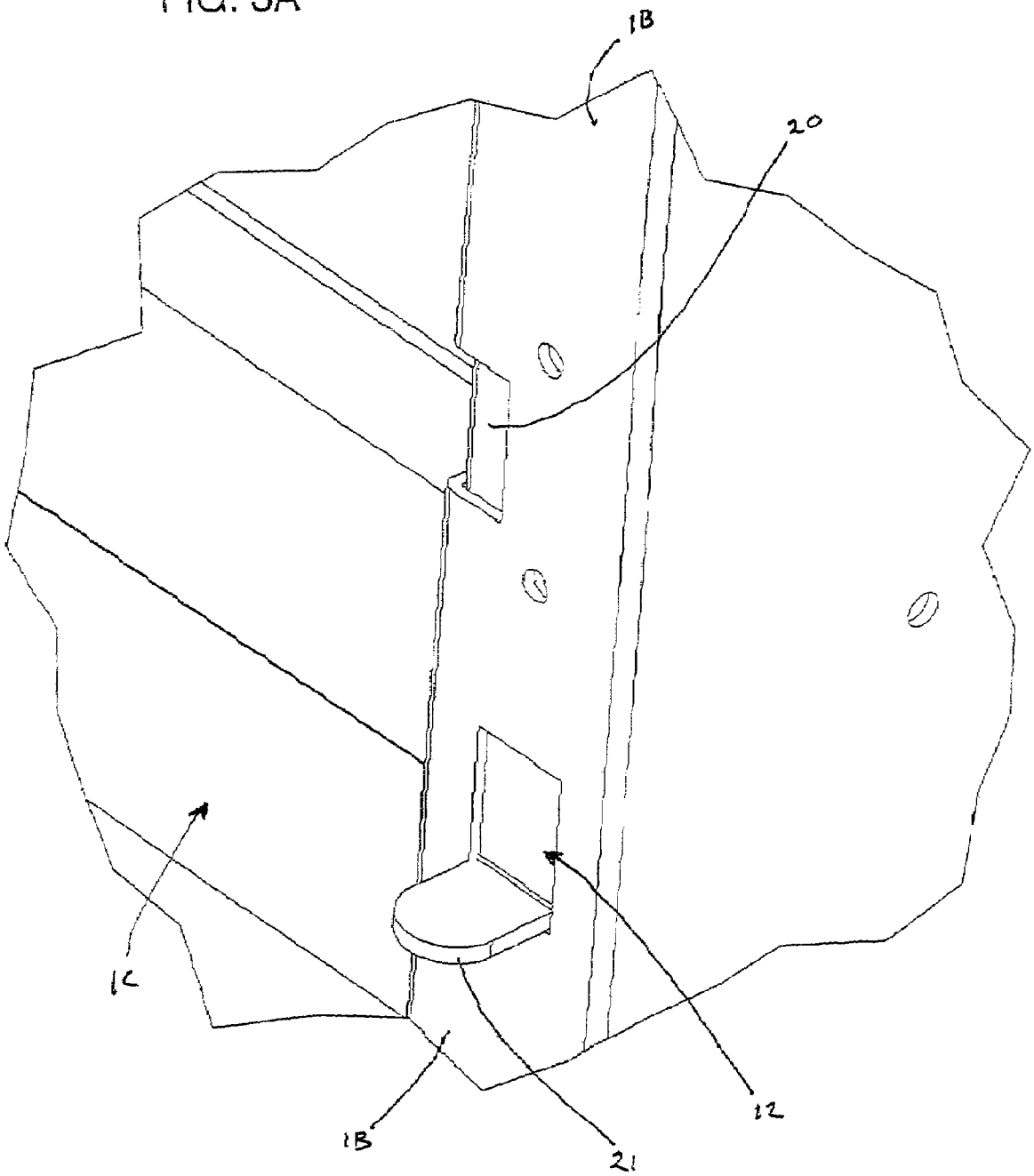

FIG. 3A provides a more detailed perspective view showing a portion of the doorframe illustrated in FIG. 1A where the sliding strike assembly of my invention is installed.

Figure 3B:
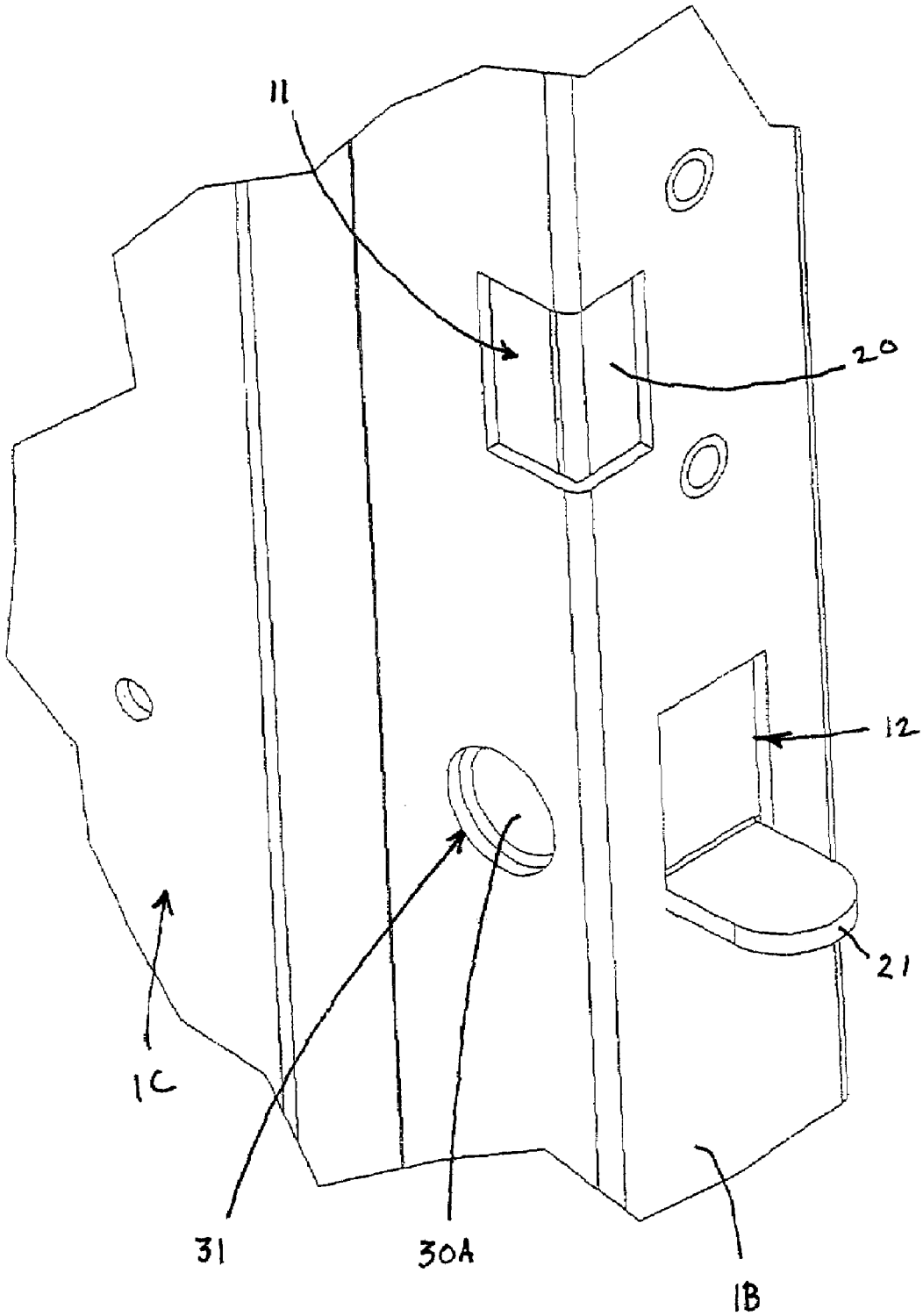

FIG. 3B provides a more detailed perspective view showing a portion of the doorframe illustrated in FIG. 1B where the sliding strike assembly of my invention is installed.

Figure 4:
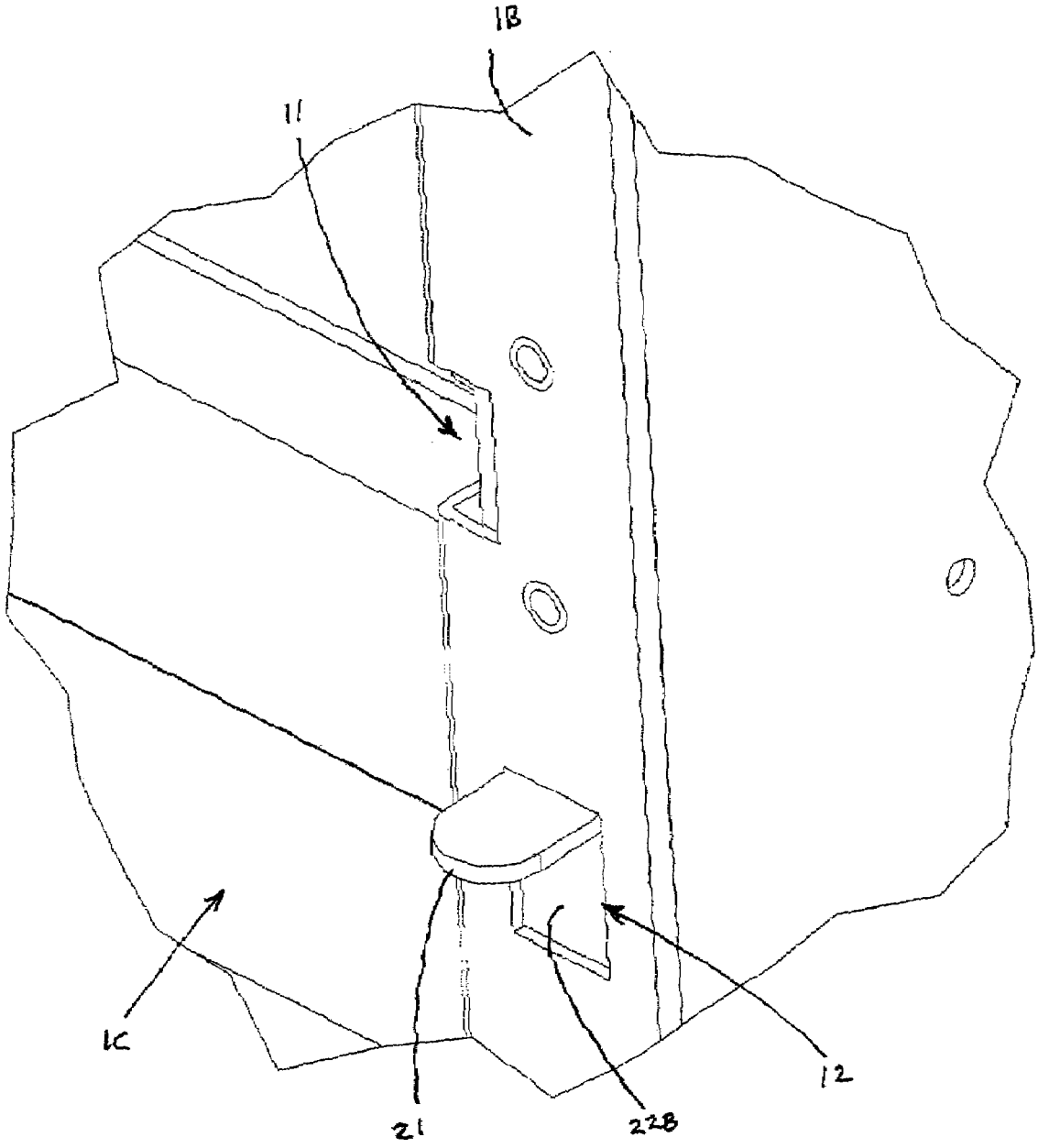

FIG. 4 provides a perspective view showing the portion of the door frame illustrated in FIG. 3A with the sliding strike of my invention moved to a position where it will not engage a latch.

Figure 5B:
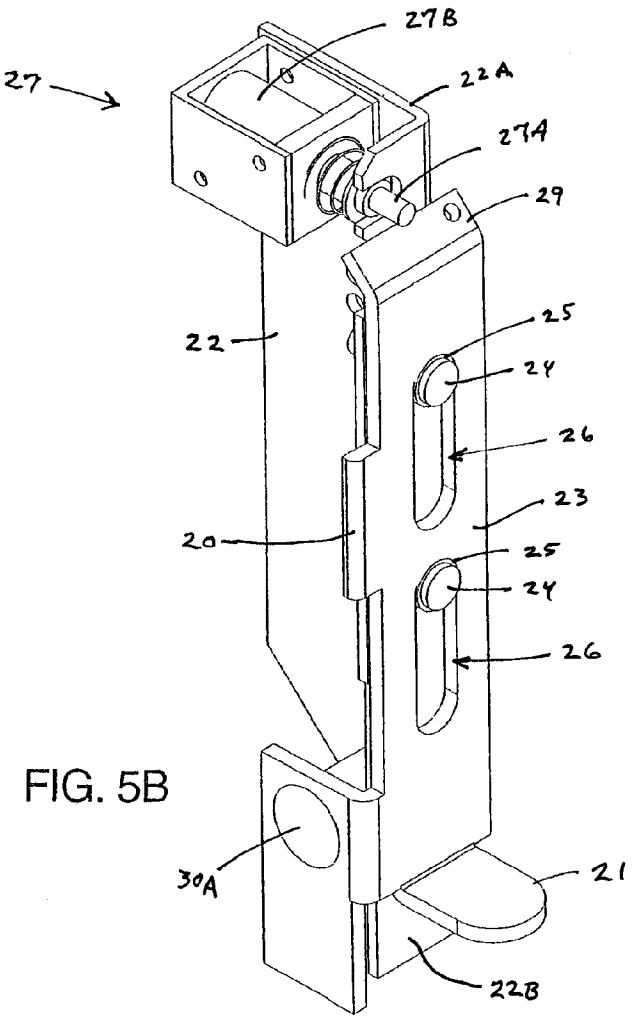
Figure 5A:
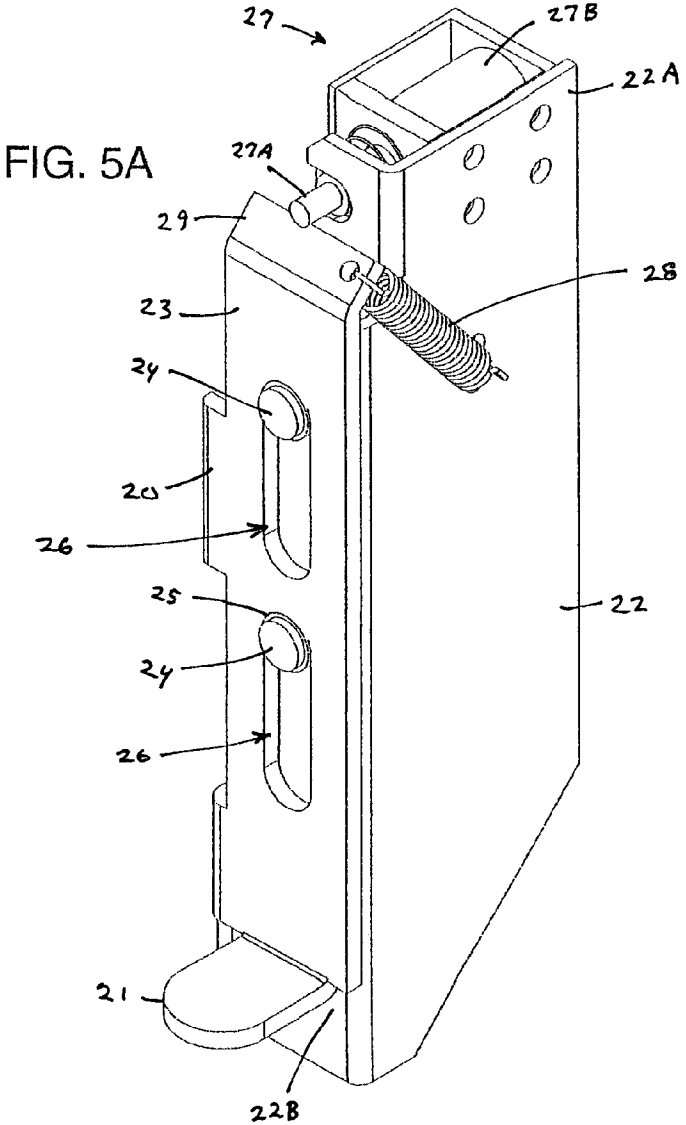

FIG. 5A provides a first perspective view of the sliding strike assembly of my invention.

FIG. 5B provides a second perspective view of the sliding strike assembly of my invention.

Figure 6A:
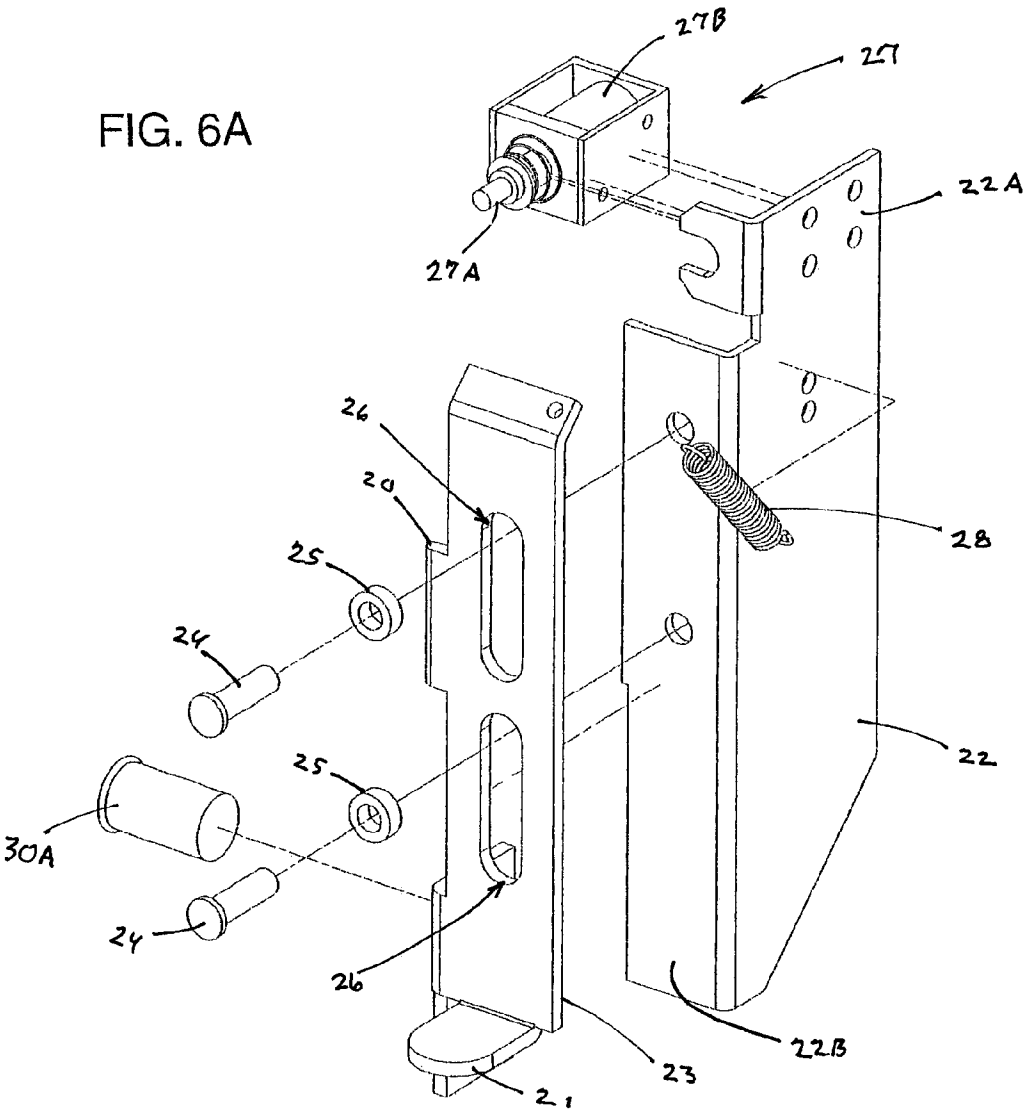

FIG. 6A provides a first exploded perspective view of the sliding strike assembly of my invention.

Figure 6B:
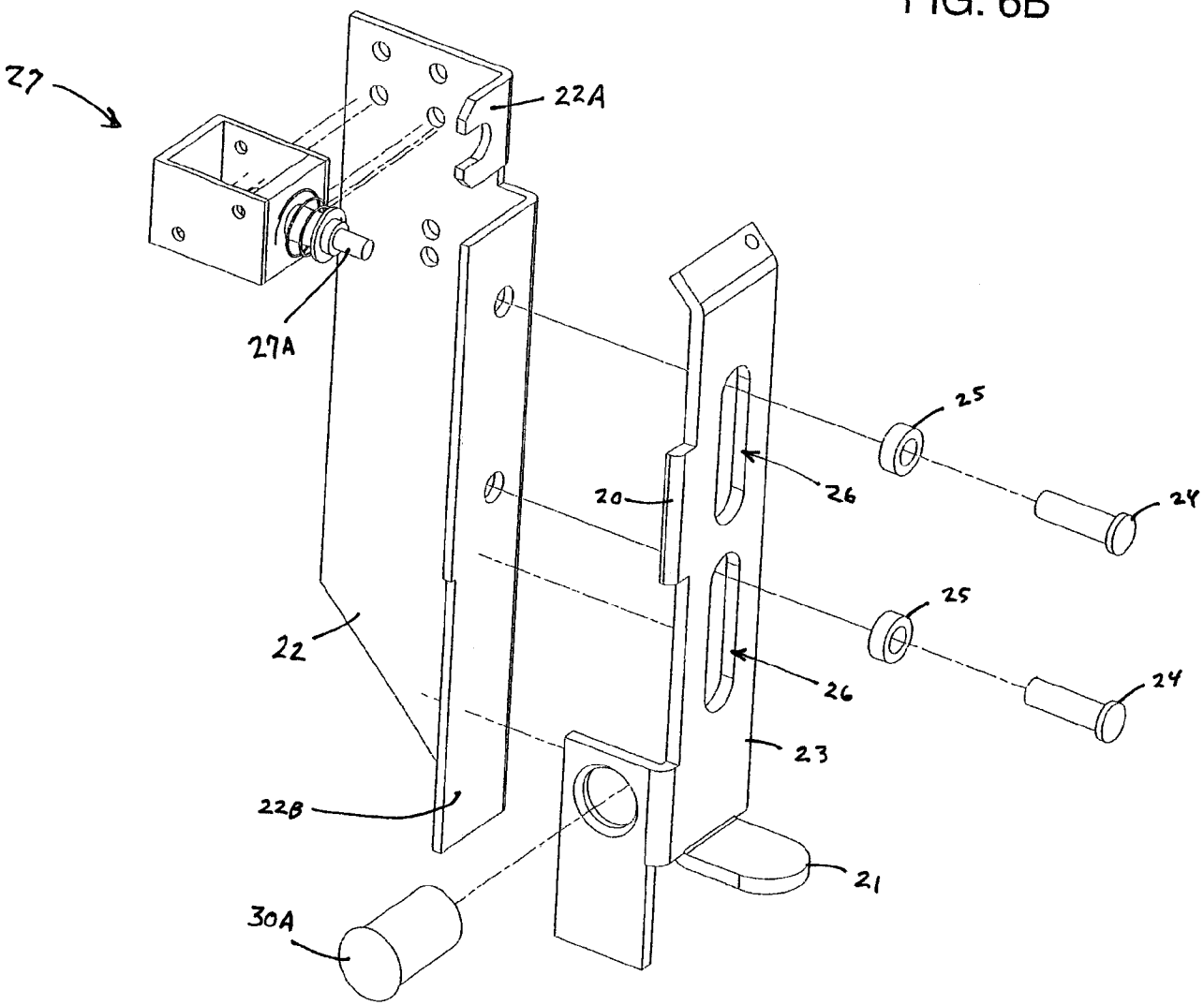

FIG. 6B provides a second exploded perspective view of the sliding strike assembly of my invention.

DETAILED DESCRIPTION OF THE INVENTION

FIGS. 1A and 1B provide perspective views of a secured asset dispenser (denoted generally by arrow 1) including an installed sliding strike assembly (denoted generally by arrow 2). As will be noted from these drawing figures, dispenser 1 includes a door 1A hinged to its body 1B and providing access to its interior (denoted generally by arrow 1C). Body 1B is provided with an electronic keyboard 3. (It is usual in the art for such a keyboard or other electronic means to be provided in order to allow entry of a PIN number or otherwise activate a solenoid and release a hinged strike, allowing a door like 1A to be opened.)

Also shown is a lock 4 provided with a slam latch mechanism 5. FIGS. 2A and 2B provide more detailed perspective views showing portions of the door illustrated in FIG. 1A where key actuated lock 4 and slam latch 5 are mounted. As will be noted, slam latch 5 is provided with a tongue 5A and a slam latch lever 5B. Cam 4A of lock 4 pushes against lever 5B when lock 4 is turned by a key, causing tongue 5A to withdraw and allowing door 1A to open. (Alternately, as discussed in more detail below, a strike portion 20 of sliding strike assembly 2 can be moved to a position where it does not engage tongue 5A, allowing door 1A to open.)

FIGS. 3A and 3B provide a more detailed perspective view showing portions of the door frame illustrated in FIGS. 1A and 1B, respectively, where sliding strike assembly 2 is installed. In these drawing figures, strike portion 20 of sliding latch strike 2 is illustrated in a first position where it can engage latch 5 via tongue 5A (which inserts behind strike portion 20 into a tongue opening indicated by arrow 11). In the position illustrated, strike portion 20 prevents door 1B from opening without a key. However, actuator 21 can be moved upward in an actuator slot (denoted by arrow 12). This moves strike portion 20 out of tongue opening 11 to a second position where it does not engage latch 5 via tongue 5A to prevent door 1B from opening. (See, FIG. 4).

The sliding strike assembly 2 by which the foregoing is accomplished is best understood by review of FIGS. 5A through 6B. As these figures illustrate, sliding strike assembly 2 includes a base member 22 with a sliding member 23. Strike portion 20 and actuator 21 are annexed to sliding member 23, so that all three form a single piece. Studs 24 surrounded by bushings 25 are used to connect base member 22 to the frame of body 1B. Sliding member 23 is mounted between base member 22 and the frame of body 1B and is held in place by the positioning of studs 24 and bushings 25 in travel limiting slots (denoted by arrows 26). Bushings 25 also act as spacers to maintain space for sliding member 23 to slide between base member 22 and the frame of body 1B.

An inhibitor (denoted generally by arrow 27) is affixed to base member 22 at an inhibitor mount 22A annexed thereto. Inhibitor 27 includes a spring biased inhibitor member 27A that is connected to or an extension of a plunger for solenoid 27B. In its normal position, as shown in FIGS. 5A and 5B, inhibitor member 27A is extended so as to block sliding member 23 from sliding upward. However, when and while activated by an electrical current, solenoid 27B withdraws inhibitor member 27A, allowing a user to manually move sliding member 23 upward via actuator 21 so as to move strike 20 out of tongue opening 11. (A lower extension 22B of base member 22 backs actuator slot 12 when sliding member 23 is moved upward so that access to the interior of body 1B is blocked.)

A biasing spring 28 returns sliding member 23 to its normal position with strike 20 in tongue opening 11 (as shown, e.g., in FIGS. 3A, 3B, 5A and 5B) as soon as actuator 21 is no longer pressed upward into the position shown in FIG. 4. As sliding member 23 returns to its normal position canted edge 29 pushes inhibitor member 27A out of the way. Inhibitor member 27A, which is spring biased to the position illustrated in FIGS. 5A and 5B, will then snap back into position blocking upward movement of sliding member 23 until solenoid 27B is, once again, triggered.

The foregoing drawing figures also illustrate another important feature of my invention: The positioning of one portion of a sensor system, first sensor element 30A, on sliding member 23. It is usual in the art for signal means of some type to be provided that will indicate whether a door of an enclosure is open or closed. Most typically, a Reed switch is provided for this purpose. Thus, a magnet of the switch is positioned in, e.g., the edge of the door and another portion of the switch positioned opposite in the edge or frame for the door such that the two portions are adjacent when the door is closed. Unfortunately, in secured enclosures with disengageable strikes, this only indicates whether the door is open/closed, not whether the strike is properly locked into position. In my invention, first sensor element 30A (one of two elements comprising a switch) is positioned on sliding member 23 such that it will be opposite second sensor element 30B of the switch only when door 1A is closed and sliding strike 20 is back in its normal position. (See, FIGS. 3A, 3B, 5A and 5B). Only in this position will first sensor element 30A be adjacent and exposed to second sensor element 30B via an aperture 31 provided in the frame of body 1B.

Thus, as illustrated and described, my invention provides a simple yet ingenious apparatus for disengageable strikes on doors. In the preferred embodiments illustrated herein, my sliding strike system is not purely automatic, but requires manual movement, adding a first additional level of security to the operation of my strike by not allowing doors to transition into an open and unlocked position without deliberate action of the user. This is particularly important when the user has access to many doors or lockers at one time. Previous systems often unlock all doors at once even though the user only enters a few. Even though some doors were not opened, they may transition to an unlocked position due to the release of the latch and the forces on the closed position door. These unlocked doors visually look locked and test closed with normal door position sensing switches, but are actually unlocked and open. In addition, the simple mechanism of my invention is jam-proof, guaranteeing that the door will open and adding another level of security. Finally, the positioning of door sensors in such a manner as to indicate not only that the door is closed but that the strike is in a secured position adds a third level of security. However, it should also be remembered that numerous changes could be made in the construction of my invention without exceeding the scope of the inventive concept outlined herein, which scope can be better judged by review of the claims that follow.

I claim:

1. An apparatus for locking an enclosure having an interior, an exterior, an aperture by which said interior is accessed from the exterior, an outwardly openable closure element which can be moved to a closed position to block said aperture and prevent access to said interior via said aperture from the exterior of said enclosure, a lock for said closure element, and an exteriorly accessible keying mechanism for said lock, comprising:

a slam latch located on one of said enclosure and said closure element, said slam latch having a closed position and an open position and being biased to said closed position;

a manually moveable strike for said slam latch located on the other of said enclosure and said closure element, which strike can be manually moved from a first to a second position via an exteriorly accessible actuator without moving the closure element from a closed position and which strike cannot be manually accessed from the exterior when the closure element is in the closed position;

a disengageable inhibitor preventing manual movement of said strike from said first position to said second position except when disengaged; and wherein said slam latch cams open upon contacting the strike when said strike is in the first position and the closure element is being closed allowing the closure element to close, which slam latch in the closed position when the closure element is closed engages the strike when the strike is in the first position to prevent the closed closure element from opening, and which strike in the second position does not engage said slam latch even when the closure element is closed and the slam latch is closed allowing the closure element to be opened; and wherein said disengageable inhibitor is electrically operated.

2. An apparatus as described in claim 1, further including a biasing spring biasing said strike towards said first position for returning said strike to the first position after it has been moved to the second position.

3. An apparatus as describe in claim 1, wherein said disengageable inhibitor includes a solenoid.

4. An apparatus as described in claim 1, further comprising a signal generator indicating a strike position.

5. An apparatus as described in claim 1, wherein said manually moveable strike is mountable to one of a closure element frame and a closure element, and said slam latch is mountable to the other of said closure element frame and closure element opposite said strike.

6. An apparatus as described in claim 1, further comprising an enclosure and a closure element providing means for accessing an interior of said enclosure, with said slam latch being mounted to one of said enclosure and said closure element and said manually moveable strike being mounted to the other of said enclosure and said closure element opposite said slam latch.

7. An apparatus as described in claim 6, wherein said strike is annexed to a strike member, which strike member is slideably mounted to a strike base, and said strike member serves as a mount for a portion of a signal generator generating signals indicating whether the closure element is closed and the strike is in the first position.

8. An apparatus as described in claim 1, wherein said strike is annexed to a strike member, which strike member is slideably mounted to a strike base.

9. An apparatus as described in claim 8, wherein an actuator for manually moving said strike member is annexed to said strike member.

10. An apparatus as described in claim 8, wherein said strike base serves as a mount for a portion of said disengageable inhibitor.

11. An apparatus for locking an enclosure having an interior, an exterior, an aperture by which said interior is accessed from the exterior, an outwardly openable closure element which can be moved to a closed position to block said aperture and prevent access to said interior via said aperture from the exterior of said enclosure, a lock for said closure element, and an exteriorly accessible keying mechanism for said lock, comprising:

a slam latch located on one of said enclosure and said closure element, said slam latch having a closed position and an open position and being biased to said closed position;

a manually moveable strike for said slam latch located on the other of said enclosure and said closure element, which strike can be manually moved from a first to a second position via an exteriorly accessible actuator without moving the closure element from a closed position and which strike cannot be manually accessed from the exterior when the closure element is in the closed position;

a disengageable inhibitor preventing manual movement of said strike from said first position to said second position except when disengaged;

wherein said slam latch cams open upon contacting the strike when said strike is in the first position and the closure element is being closed allowing the closure element to close, which slam latch in the closed position when the closure element is closed engages the strike when the strike is in the first position to prevent the closed closure element from opening, and which strike in the second position does not engage said slam latch even when the closure element is closed and the slam latch is closed allowing the closure element to be opened;

wherein said strike is annexed to a strike member, which strike member is slideably mounted to a strike base; and wherein said actuator protrudes through an opening in one of said closure element and said enclosure.

12. An apparatus as described in claim 11, wherein said strike base blocks said opening when said actuator is used to move the strike from the first position to the second position.

13. An apparatus as described in claim 11, wherein said strike is a sliding strike.

14. An apparatus as described in claim 13, wherein said strike base blocks said opening when said actuator is used to move the strike from the first position to the second position.

15. An apparatus as described in claim 11, further including a signal generator indicating a strike position.

16. An apparatus as described in claim 15, wherein said strike base blocks said opening when said actuator is used to move the strike from the first position to the second position.

17. An apparatus for locking an enclosure having an interior, an exterior, an aperture by which said interior is accessed from the exterior, an outwardly openable closure element which can be moved to a closed position to block said aperture and prevent access to said interior via said aperture from the exterior of said enclosure, a lock for said closure element, and an exteriorly accessible keying mechanism for said lock, comprising:

A slam latch located on one of said enclosure and said closure element, said slam latch having a closed position and an open position and being biased to said closed position;

a sliding strike for said slam latch located on the other of said enclosure and said closure element, which strike can be manually slid from a first to a second position via an exteriorly accessible actuator without moving the closure element from a closed position and which strike cannot be manually accessed from the exterior when the closure element is in a closed position;

a disengageable inhibitor preventing said strike from sliding from said first position to said second position except when disengaged;

wherein said slam latch cams open upon contacting the strike when said strike is in the first position and the closure element is being closed allowing the closure element to close, which slam latch in the closed position when the closure element is closed engages the strike when the strike is in the first position to prevent the closed closure element from opening, and which strike in the second position does not engage said slam latch even when the closure element is closed and the slam latch is closed allowing the closure element to be opened; and wherein said disengageable inhibitor is electrically operated.

18. An apparatus as described in claim 17, further including a biasing spring biasing said strike towards said first position for returning said strike to the first position after it has been slid to the second position.

19. An apparatus as describe in claim 17, wherein said disengageable inhibitor includes a solenoid.

20. An apparatus as described in claim 17, further comprising a signal generator indicating a strike position.

21. An apparatus as described in claim 17, wherein said sliding strike is mountable to one of a closure element frame and a closure element, and said slam latch is mountable to the other of said closure element frame and closure element opposite said strike.

22. An apparatus as described in claim 21, further comprising an enclosure and a closure element providing means for accessing an interior of said enclosure, with said slam latch being mounted to one of said enclosure and said closure element and said sliding strike being mounted to the other of said enclosure and said closure element opposite said slam latch.

23. An apparatus as described in claim 22, wherein said strike is annexed to a strike member, which strike member is slideably mounted to a strike base, and said strike member serves as a mount for a portion of a signal generator generating signals indicating whether the closure element is closed and the strike is in the first position.

24. An apparatus as described in claim 17, wherein said strike is annexed to a strike member, which strike member is slideably mounted to a strike base.

25. An apparatus as described in claim 24, wherein an actuator for manually moving said strike member is annexed to said strike member.

26. An apparatus as described in claim 24, wherein said strike base serves as a mount for a portion of said disengageable inhibitor.

27. An apparatus for locking an enclosure having an interior, an exterior, an aperture by which said interior is accessed from the exterior, an outwardly openable closure element which can be moved to a closed position to block said aperture and prevent access to said interior via said aperture from the exterior of said enclosure, a lock for said closure element, and an exteriorly accessible keying mechanism for said lock, comprising:

a slam latch located on one of said enclosure and said closure element, said slam latch having a closed position and an open position and being biased to said closed position:

a disengageable strike for said slam latch located on the other of said enclosure and said closure element, which strike can be moved from a first to a second position via an exteriorly accessible actuator without moving the closure element from a closed position and which strike cannot be manually accessed from the exterior when the closure element is in the closed position;

a disengageable inhibitor preventing said strike from moving from said first position to said second position except when disengaged;

a signal generator indicating a strike position; and wherein said slam latch cams open upon contacting the strike when said strike is in the first position and the closure element is being closed allowing the closure element to close, which slam latch in the closed position when the closure element is closed engages the strike when the strike is in the first position to prevent the closed closure element from opening, and which strike in the second position does not engage said slam latch even when the closure element is closed and the slam latch is closed allowing the closure element to be opened; and wherein said disengageable inhibitor is electrically operated.

28. An apparatus as described in claim 27, further including an actuator for manually moving said strike.

29. An apparatus as described in claim 27, further including a biasing spring biasing said strike towards said first position for returning said strike to the first position after it has been moved to the second position.

30. An apparatus as describe in claim 27, wherein said disengageable inhibitor includes a solenoid.

31. An apparatus as described in claim 27, further comprising a signal generator indicating whether the strike is in the first position.

32. An apparatus as described in claim 27, wherein said sliding strike is mountable to one of a closure element frame and a closure element, and said slam latch is mountable to the other of said closure element frame and closure element opposite said strike.

33. An apparatus as described in claim 27, further comprising an enclosure and a closure element providing means for accessing an interior of said enclosure, with said slam latch being mounted to one of said enclosure and said closure element and said sliding strike being mounted to the other of said enclosure and said closure element opposite said slam latch.

34. An apparatus as described in claim 33, wherein said strike is annexed to a strike member, which strike member is slideably mounted to a strike base, and said strike member serves as a mount for a portion of a signal generator generating signals indicating whether the closure element is closed and the strike is in the first position.

35. An apparatus as described in claim 27, wherein said strike is annexed to a strike member, which strike member is slideably mounted to a strike base.

36. An apparatus as described in claim 35, wherein an actuator for manually moving said strike member is annexed to said strike member.

37. An apparatus as described in claim 35, wherein said strike base serves as a mount for a portion of said disengageable inhibitor.

38. An apparatus for locking an enclosure having an interior, an exterior, an aperture by which said interior is accessed from the exterior, an outwardly openable closure element which can be moved to a closed position to block said aperture and prevent access to said interior via said aperture from the exterior of said enclosure, a lock for said closure element, and an exteriorly accessible keying mechanism for said lock, comprising:

a slam latch located on one of said enclosure and said closure element, said slam latch having a closed position and an open position and being biased to said closed position;

a manually slideable strike for said slam latch located on the other of said enclosure and said closure element, which strike can be slid from a first to a second position via an exteriorly accessible manual actuator without moving the closure element from a closed position and which strike cannot be manually accessed from the exterior when the closure element is in the closed position;

a disengageable inhibitor preventing manual movement of said strike from said first position to said second position except when disengaged;

wherein said slam latch cams open upon contacting the strike when said strike is in the first position and the closure element is being closed allowing the closure element to close, which slam latch in the closed position when the closure element is closed engages the strike when the strike is in the first position to prevent the closed closure element from opening, and which strike in the second position does not engage said slam latch even when the closure element is closed and the slam latch is closed allowing the closure element to be opened; and wherein said disengageable inhibitor is electrically operated.

39. An apparatus as described in claim 38, further including a biasing spring biasing said strike towards said first position for returning said strike to the first position after it has been moved to the second position.

40. An apparatus as describe in claim 38, wherein said disengageable inhibitor includes a solenoid.

41. An apparatus as described in claim 38, further comprising a signal generator indicating a strike position.

42. An apparatus as described in claim 38, further comprising an enclosure and a closure element providing means for accessing an interior of said enclosure, with said slam latch being mounted to one of said enclosure and said closure element and said manually moveable strike being mounted to the other of said enclosure and said closure element opposite said slam latch.

43. An apparatus as described in claim 38, wherein said strike is annexed to a strike member, which strike member is slideably mounted to a strike base.

44. An apparatus as described in claim 43, wherein said actuator for manually moving said strike member is annexed to said strike member.

45. An apparatus as described in claim 44, wherein said actuator protrudes through an opening in one of said closure element and said enclosure and said strike base blocks said opening when said actuator is used to move the strike from the first position to the second position.

46. An apparatus as described in claim 43, wherein said strike base serves as a mount for a portion of said disengageable inhibitor.

47. An apparatus as described in claim 43, wherein said strike member serves as a mount for a portion of a signal generator indicating whether the closure element is closed and the strike is in the first position.

* * * * *